US008075724B2

(12) United States Patent
Deiss

(10) Patent No.: US 8,075,724 B2
(45) Date of Patent: Dec. 13, 2011

(54) SEALING STRIP OF SOFT FOAM

(75) Inventor: Martin Deiss, Abtsgmuend (DE)

(73) Assignee: ISO-Chemie GmbH (DE)

( * ) Notice: Subject to any disclaimer, the term of this patent is extended or adjusted under 35 U.S.C. 154(b) by 381 days.

(21) Appl. No.: 12/415,668

(22) Filed: Mar. 31, 2009

(65) Prior Publication Data

US 2009/0246498 A1 Oct. 1, 2009

(30) Foreign Application Priority Data

Mar. 31, 2008 (EP) ..... 08006368

(51) Int. Cl.

| | |
|---|---|
| ***B32B 37/02*** | (2006.01) |
| ***B32B 37/00*** | (2006.01) |
| ***B32B 38/00*** | (2006.01) |
| ***B32B 38/04*** | (2006.01) |

(52) U.S. Cl. ..... 156/256; 156/152; 156/250; 156/252; 156/253; 156/269

(58) Field of Classification Search ..... 156/152, 156/250, 252, 253, 256, 269
See application file for complete search history.

(56) References Cited

U.S. PATENT DOCUMENTS

| | | | | |
|---|---|---|---|---|
| 3,881,980 | A * | 5/1975 | Olson | 156/268 |
| 4,401,716 | A * | 8/1983 | Tschudin-Mahrer | 428/317.3 |
| 4,740,256 | A * | 4/1988 | Vosberg | 156/73.1 |
| 5,128,176 | A * | 7/1992 | Schmidt | 427/140 |
| 2001/0015260 | A1 * | 8/2001 | Ager et al. | 156/344 |

FOREIGN PATENT DOCUMENTS

DE 19641415 A1 4/1998

* cited by examiner

*Primary Examiner* — Mark A Osele
*Assistant Examiner* — Christopher C Caillouet
(74) *Attorney, Agent, or Firm* — Jansson Shupe & Munger Ltd

(57) ABSTRACT

The sealing strip roll has a partially compressed, open-cell, soft foam, which undergoes delayed recovery after compression and subsequent release. A thin, closed layer of a flexible or film-like material with a thickness of 0.002-0.5 mm is bonded to the foam on at least one side surface of the foam.

6 Claims, 3 Drawing Sheets

SEALING STRIP OF SOFT FOAM

CROSS REFERENCE TO RELATED APPLICATION

This application claims priority based on European patent application EP 08 006 368.8, filed Mar. 31, 2008.

FIELD OF THE INVENTION

The invention pertains to a sealing strip roll comprising partially compressed, open-cell soft foam which undergoes delayed recovery after compression and subsequent release.

BACKGROUND

Sealing strips of soft and flexible foam material are used generally in the construction industry to provide a seal against drafts and driving rain. In the field of professional building construction, these sealing strips are installed, for example, between the frames of windows and doors, and a masonry wail. The sealing strips can be up to several centimeters thick and are usually provided on one side with a layer of pressure-sensitive adhesive, by means of which they can be attached to the frame profile elements of windows and doors. Sealing strips of this type are often impregnated with a material which delays the recovery of the foam material from the partially compressed state in which it is delivered on rolls back to the relaxed state. The purpose of such treatment is to facilitate the installation of the structural element provided with the sealing strip at the construction site.

To prevent the diffusion of vapor, it is necessary to use sealing strips of the previously mentioned type which have been provided with a vapor harrier. A sealing strip of open-pored material, which has been rolled up into a disk and which is used to seal joints or gaps against drafts and driving rain, is known from DE 196 41 415 C2. At least one barrier layer is arranged inside the sealing strip in such a configuration that it and the adjacent open-pored areas form a row in the axial direction. The barrier layer therefore extends in the radial direction of the sealing strip roll. It is a relatively complicated manner to produce sealing strips of this type, and a high degree of dimensional accuracy of the foam material is required during processing.

Publication DE 24 57 322 A1 discloses a process for providing plastic object formed of open-pore foam with a sprayed polyurethane coating on their outside surfaces. Such processing serves to prolong the life of children's toys and other foam objects because it avoids open exterior areas of the open-pore foam. The process requires that the foam be prepared in a special manner before the coating is applied. Accordingly, it is desirable to provide economical sealing strip foam rolls with improved sealing properties and longevity.

SUMMARY OF THE INVENTION

It is an object of the present invention to create a method for producing a sealing strip roll of soft foam which involves relatively low cost, and a corresponding sealing strip which is easy to handle and shows very good sealing properties.

The process for producing a sealing strip roll comprises the steps of providing a web of a soft, open-cell foam and impregnating the foam to delay its recovery after compression and subsequent release. The foam web is rolled up onto a wide roll and cut into narrow scaling strip rolls. Each sealing strip roll is unwound and a thin, closed layer of a flexible or film-like material with a thickness of 0.002-0.5 mm is applied and continuously bonded to at least one side surface of the foam. The foam is then rolled up into a sealing strip roll in which the foam is present in a partially compressed state.

In this way it possible at economical cost to provide one side surface of the sealing strip roll with the thin, closed layer, wherein the thin, closed layer is applied while the foam is in the fully expanded state.

Preferably a thin, closed layer of a polyurethane compound is sprayed directly onto the side surface of the foam. When the polyurethane compound cures, it bonds to the foam. In one embodiment, the layer of the polyurethane compound is sprayed onto the side surface of the foam at a coating density in the range of 20-150 g/m$^2$, and no blowing agent is used. Such parameters provide that the closed layer of polyurethane compound will provide a superior sealing action and, at the same time, will remain elastic enough so that it will not cause any damage when the foam is compressed.

According to another aspect of the invention, the sealing strip roll comprises partially compressed, open-cell, soft foam which, after compression, undergoes delayed recovery upon subsequent release. A thin, closed layer of a flexible or film-like material with a thickness of 0.002-0.5 mm is bonded continuously to the foam on at least one side surface of the sealing strip roll.

Thus a sealing strip roll is easily produced which is especially suitable for sealing joints in the construction field and which, in addition to being easy to handle, also offers extremely high insulation and sealing values.

The closed layer can preferably consist either of a thermally applied hot-melt adhesive film, of an adhesively attached plastic film, or of an adhesively attached closed-cell foam material. In an alternative embodiment, the closed layer may consist of a polyurethane compound banded directly to the foam.

In a preferred embodiment, the layer of polyurethane compound covers the foam preferably completely, without-any gaps, and comprises essentially no air inclusions. Such coverage ensures that the bond between the closed layer and the foam can be made especially strong and that simultaneously the sealing action of the sealing strip roll can be brought to and maintained at a very high value.

In addition, to provide an improved sealing lip function, the thin closed layer can also be applied to at least one section of the top surface. In another embodiment, improved sealing functionality can be achieved when the thin closed layer is applied to the bottom surface of the foam adjacent to the side surface to be coated.

BRIEF DESCRIPTION OF THE DRAWINGS

Additional properties, features, and advantages of the present invention can be derived from the following detailed description, which makes reference to the drawings.

DETAILED DESCRIPTION OF THE INVENTION

Figure 1:
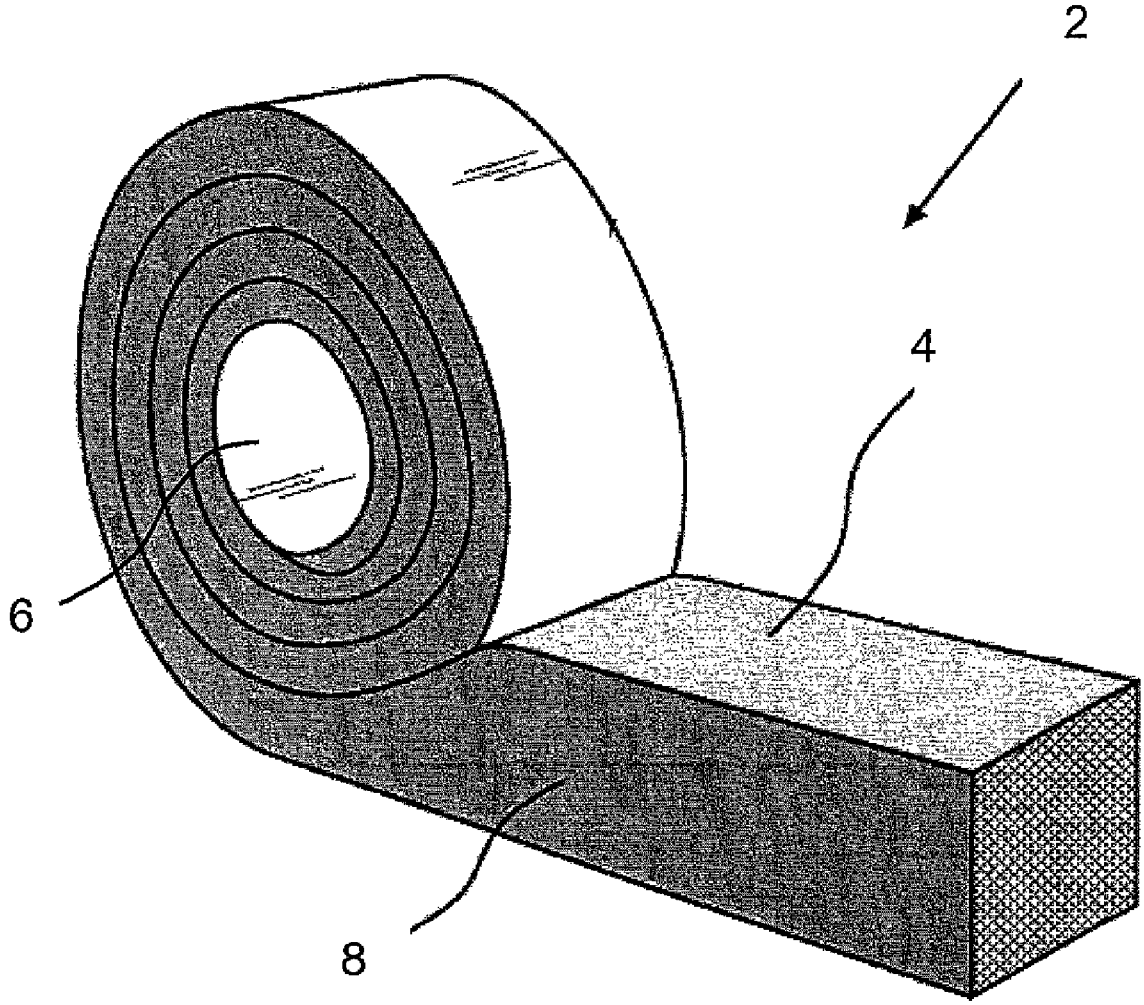
FIG. 1 shows a sealing strip roll in a partially unwound state.

The sealing strip roll 2 shown in FIG. 1 consists of a soft, open-cell foam 4, which is preferably rectangular in cross section and which is wound up in the longitudinal direction around a sleeve 6. In the rolled-up state, foam 4 is partially compressed. This is how sealing strip rolls are usually put on the market, and they are unwound only just before they are used at the construction site. As a result of packaging in this manner, foam 4 returns to its final, fully expanded functional state or at least into its partially expanded functional state when installed. To delay the recovery of foam 4 upon release after compression, and specifically after sealing strip roll 2 has been unwound, making it easier to Install the strip In the joints to be sealed, open-cell foam 4 is usually impregnated with a sticky impregnation material Such material considerably delays the return of foam 4 to the expanded state by up to several hours.

Figure 2:
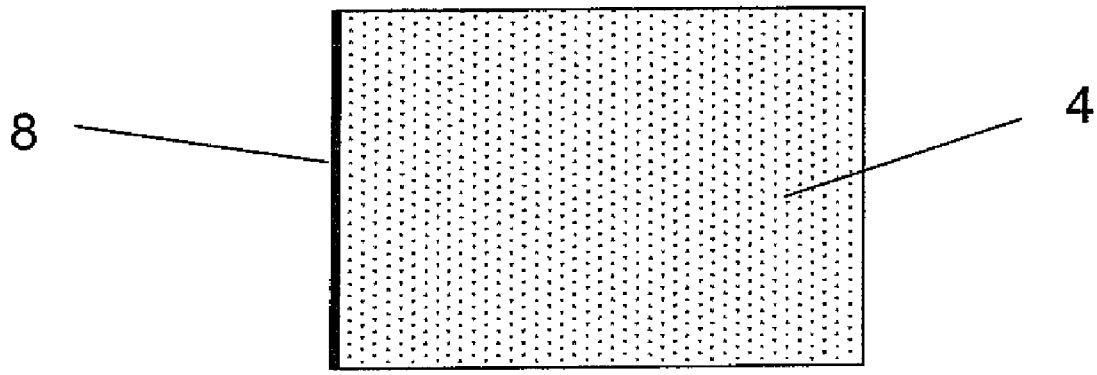
FIG. 2 is a cross-sectional view of a first embodiment of the sealing strip roll of FIG. 1.

In the embodiment shown in FIGS. 1 and 2, a thin, closed layer 8 of a flexible or film-like material with a thickness of 0.002-0.5 mm, and preferably of 0.005-0.015 mm, is applied to one of the side surfaces of the foam material 4 and bonded directly to foam 4. It is also possible to cover both side surfaces with a thin layer 8. When sealing strip roll 2 is in the partially compressed state, honeycomb-like, wave-like or fold formations may occur in the closed layer.

On the bottom surface of foam 4, a layer of pressure-sensitive adhesive (not shown here) can be provided for the attachment of the sealing strip to the window frame, door frame, or the like. The layer of pressure-sensitive adhesive may also be protected by a cover film.

Foam 4 usually consists of a polyurethane foam, but any other suitable type of soft, open-cell foam may also be considered and used. Foam 4 may consist of but is not limited to, polyester polyurethane foam, flexible polyester polyurethane foam, pyrell foam, polyether polyurethane foam, low permeability foam, polyimide foam, high density foam, evlon or lux foam, high resilience foam, melamine foam and the like. The usual thickness of the foam in the transverse direction, that is, perpendicular to the side surface covered with the closed layer, is in the range of 8-200 mm.

Thin, closed layer 8 can be produced in many different ways. It can, for example, consist of a thermally applied hot-melt adhesive film of a thermoplastic which can be heat-laminated, such as a polyvinyl acetate, ethylene vinyl acetate, polyolefin, polyethylene or the like.

It is also possible to glue on a thin layer of plastic film or of closed-cell foam to foam 4. If the two layers are neither thermoplastic nor sell-adhesive, it will be necessary U) use an adhesive component for this purpose. Suitable adhesives include, for example, polyurethane adhesives, acrylate systems and the like. It is also possible to use a finished, stable film, which is adhesive on one or both sides. Suitable materials for such a film may include any plastic such as polyethylene, polyvinyl chloride, polyurethane and the like. Acrylate adhesives and their variants are the most commonly used adhesives in such applications.

An especially preferred variant is "skinning", that is, the coating of foam 4 with a liquid compound which cures without leaving a sticky surface and which covers the entire side surface without any gaps. Such "skinning" is usually accomplished by spraying the compound onto the side surface, as will be explained in greater detail below.

In the case of a porous substrate such as a polyurethane foam 4, the coating density of the applied coat must be approximately 20 g/m$^2$ (dry) for a lower limit and approximately 150 g/m$^2$ for an upper limit. Polyurethane systems arc especially suitable as skin materials as they react completely in a short time, are decorative, are highly flexible, and show good chemical resistance. This closed polyurethane compound layer consists of a polymer matrix without any significant air inclusions and is therefore able to significantly improve the sealing function of the foam 4 of the sealing strip. In addition, the use of such a polymer matrix allows the sealing strip and foam 4 to be more resistant to outside influences. The sprayed-on foam skin is highly reactive and forms a strong adhesive bond with foam 4.

Figure 3:
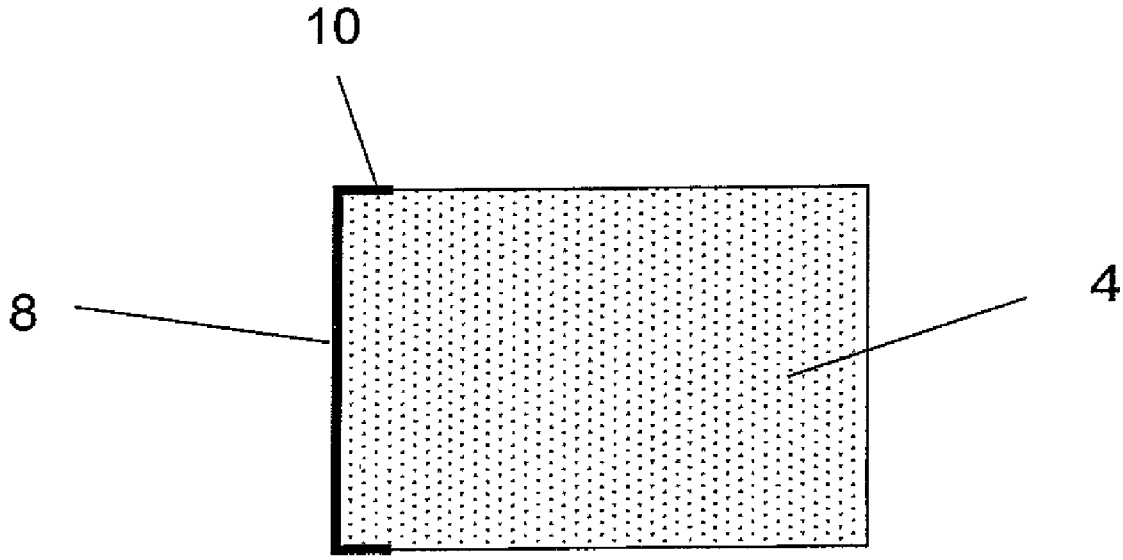
FIG. 3 shows an alternative embodiment, in which the thin, closed layer is also applied to a section of the top surface and of the bottom surface of the foam.

As shown in FIGS. 1 and 2, a side surface of foam 4 is coated with thin, closed layer 8. As shown in FIG. 3, it is also contemplated that at least a section 10 of the top-surface of foam 4 and/or of the bottom surface of foam 4 could also be coated with a thin layer 8. As a result, a type of sealing lip is achieved, which improves the sealing properties of foam 4 as the sealing strip continues in use.

Figure 4:
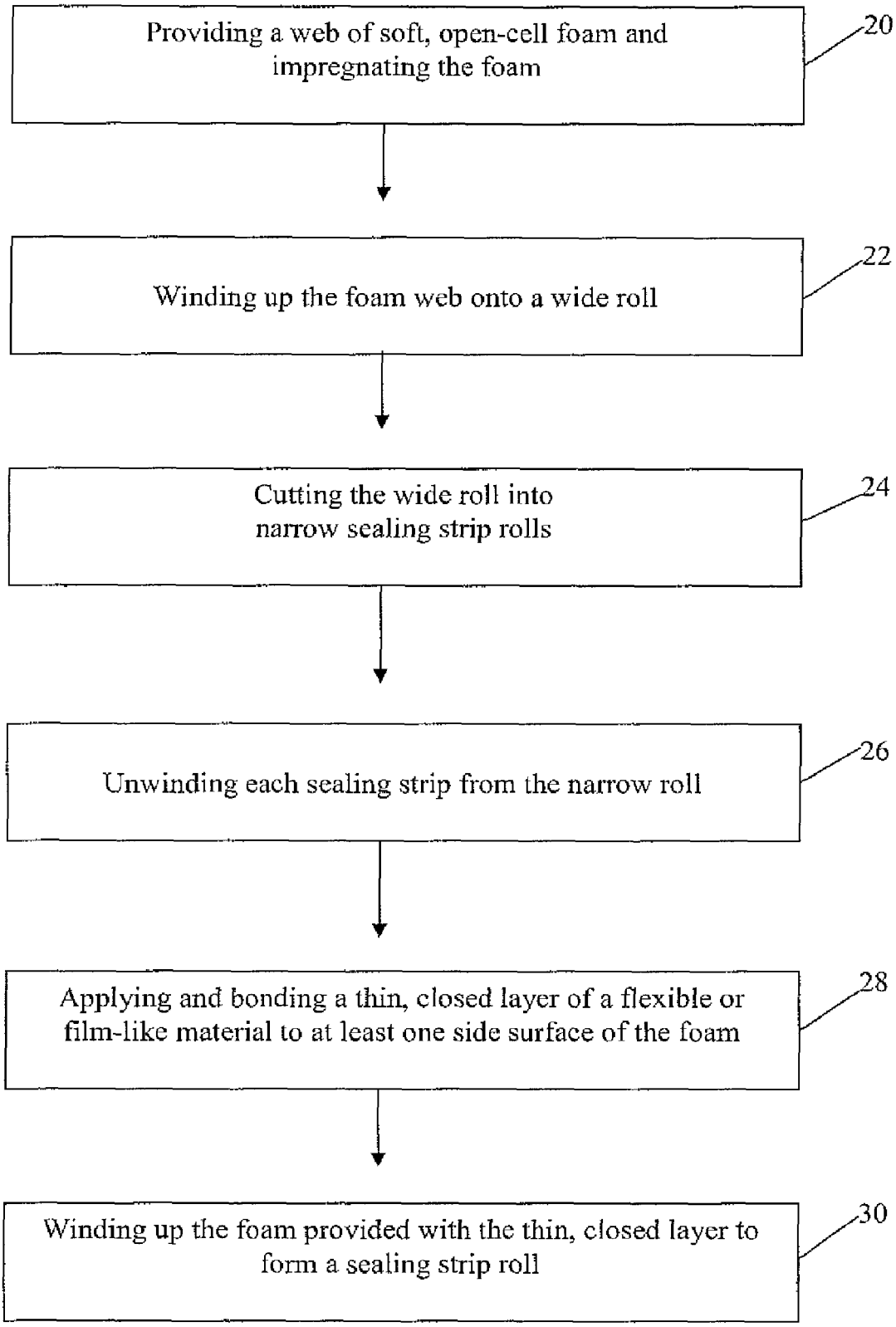
FIG. 4 shows a flow chart of the inventive method of producing a sealing strip roll.

FIG. 4 shows a flow chart of the steps of the inventive method of producing a sealing strip roll of the type disclosed herein. First, in step 20, a web of a soft, open-cell foam 4 is prepared, and this is preferably impregnated by soaking it in a bath containing an impregnation agent such as an acrylate-based material. As a result, foam 4 acquires the property of delayed recovery after compression and subsequent release.

Then, in step 22, the impregnated foam web is wound up onto a wide roll, and in step 24 this roll is cut into narrow sealing strip rolls. To apply the thin, closed layer 8, each sealing strip roll 2 is unwound again (step 26), and thin, closed layer 8 of flexible or film-like material with a thickness 0.002-0.5 mm is applied directly to the side surface of foam 4, preferably while the foam is in the uncompressed state, and then continuously bonded to it (step 28). The flexible or film-like material can be applied thermally or by adhesive bonding, but it is preferably applied by spraying a polyurethane compound onto the side surface. After application and possibly after the curing of the thin layer 8, the foam strip provided with closed layer 8 is rolled back up again into a sealing strip roll in step 30, in which foam 4 is in the partially compressed state. In this state, the sealing strip roll is ready for sale and subsequent use.

While the sealing strip roll and method of making the same as herein shown and described in detail is fully capable of attaining the above-described objects, it is to be understood that preferred embodiments of the present invention have been described herein and is thus representative of the subject matter which is broadly contemplated by the present invention. It should also be understood that the scope of the present invention fully encompasses other embodiments which may become obvious to those skilled in the art. The present invention may be embodied in other specific forms without departing from its spirit or essential characteristics. The described embodiments are to be considered in all respects only as illustrative and not restrictive. All changes which come within the meaning and range of equivalency of the claims are to be embraced within their scope.

Furthermore, the described features, advantages, and characteristics of the invention may be combined in any suitable manner in one or more embodiments. One skilled in the art will recognize that the invention may be practiced without one or more of the specific features or advantages of a particular embodiment. In other instances, additional features and advantages may be recognized in certain embodiments that may not be present in all embodiments of the invention.

Reference throughout this specification: to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

What is claimed is:

1. A method of producing a sealing strip roll, comprising:

providing a web of a soft, open-cell foam;

impregnating the foam to delay the recovery of the foam alter its compression and subsequent release;

rolling up the foam web onto a wide roll and cutting the wide roll into narrow sealing strip rolls;

unwinding each sealing strip roll and applying and bonding a thin, closed layer of a flexible or film-like material with a thickness of 0.002-0.5 mm to at least one side surface of the foam; and rolling up the foam provided with the thin closed layer into a sealing strip roll, in which the foam is present in a partially compressed state.

2. The method of claim 1 wherein the step of applying and bonding the thin, closed layer comprises the thermal application of a hot-melt adhesive film.

3. The method of claim 1 wherein the step of applying and bonding the thin, closed layer comprises the adhesion of a layer of a plastic film or a closed-cell foam.

4. The method of claim 1 wherein the step of applying and bonding the thin, closed layer comprises the application of a self-adhering film, which is adhesive at least on the side facing the foam.

5. The method of claim 1 wherein the step of applying and bonding the thin, closed layer comprises the spraying-on of a polyurethane compound, which bonds directly to the foam as it cures.

6. The method of claim 5 wherein the step of spraying on the closed layer of the polyurethane compound comprises the spraying of the polyurethane compound on the side surface of the foam at an applied coating density of 20-150 $g/m^2$, wherein the addition of a blowing agent is omitted.

* * * * *